US008529268B2

(12) United States Patent
Coleman et al.

(10) Patent No.: US 8,529,268 B2
(45) Date of Patent: Sep. 10, 2013

(54) SKI OR SNOWBOARD TEACHING APPARATUS

(75) Inventors: R. Scott Coleman, Ogden, UT (US); Samuel Richard Hunter, Ogden, UT (US)

(73) Assignee: Scott R. Coleman, Ogden, UT (US)

( * ) Notice: Subject to any disclaimer, the term of this patent is extended or adjusted under 35 U.S.C. 154(b) by 492 days.

(21) Appl. No.: 12/768,996

(22) Filed: Apr. 28, 2010

(65) Prior Publication Data

US 2011/0269107 A1 Nov. 3, 2011

(51) Int. Cl.
*A63B 69/18* (2006.01)

(52) U.S. Cl.
USPC ..... 434/253

(58) Field of Classification Search
USPC ..... 434/253
See application file for complete search history.

(56) References Cited

U.S. PATENT DOCUMENTS 2,490,183 A * 12/1949 Wheeler ..... 280/606
3,153,527 A * 10/1964 Giglioli ..... 248/460
3,885,805 A * 5/1975 Solymosi ..... 280/606
4,505,681 A 3/1985 Jones
4,509,921 A 4/1985 Buchheister et al.
4,793,627 A * 12/1988 Monreal ..... 280/606
7,137,925 B2 11/2006 Rozycki et al.
2002/0011727 A1 1/2002 Kernan

FOREIGN PATENT DOCUMENTS

JP 07-022784 U 4/1995
JP 07-37257 U 7/1995
WO PCT/US11/21564 9/2011

OTHER PUBLICATIONS

Easy Wedge product description, available at http://luckybums.com/easywedge.aspx, accessed on Apr. 27, 2010.

* cited by examiner

*Primary Examiner* — Gene Kim
*Assistant Examiner* — Joseph B Baldori
(74) *Attorney, Agent, or Firm* — Maschoff Brennan

(57) ABSTRACT

In one example, an apparatus for teaching a student how to snow ski includes a removably attachable instructor component, a removably attachable student component, and means for temporarily securing the instructor component and student component together. The instructor component has a first end defining a cavity configured to receive a bottom end of an instructor's ski pole and a second end disposed opposite the first end. The student component has a first end configured to attach to a portion of a student's ski equipment and a second end disposed opposite the first end.

17 Claims, 9 Drawing Sheets

SKI OR SNOWBOARD TEACHING APPARATUS

BACKGROUND

1. Field of the Invention

Embodiments of the present invention generally relate to ski and/or snowboard instruction. More particularly, some example embodiments relate to an apparatus for teaching a student to ski or snowboard.

2. Related Technology

Teaching a beginner skier or snowboarder (generically referred to herein as a "beginner" or "beginners") to ski or snowboard can be difficult and/or uncomfortable for ski or snowboard instructors (generically referred to herein as an "instructor" or "instructors"). Generally, beginners, whether skiers or snowboarders, lack the knowledge, balance and/or coordination necessary to ski or snowboard using correct form. Due to their lack of knowledge, balance and/or coordination, many beginners may, on occasion, accelerate out of control and become a danger to themselves and those around them. Additionally, many beginners are young children that are physically small in stature.

Various techniques are currently used by instructors to teach a beginner to ski or snowboard. For instance, instructors often ski/snowboard backwards immediately in front of a beginner or frontwards and immediately behind the beginner. The proximity of the instructor relative to the beginner permits the instructor to physically hold the beginner up in an attempt to show the beginner correct form and/or to brake the beginner in the event the beginner accelerates out of control. However, backward skiing/snowboarding by the instructor can be uncomfortable and/or dangerous for the instructor. Or, when the instructor is skiing/snowboarding frontwards and immediately behind the beginner, there is a danger that the beginner may accelerate beyond the reach of the instructor such that the instructor is unable to brake the beginner.

Moreover, to the extent the beginner is a young child or otherwise small in physical stature compared to the instructor, the instructor may have to bend over or crouch down for extended periods of time to hold up and direct the beginner using either of the backward or frontward techniques where the instructor is immediately in front of or behind the beginner. Crouching down for any amount of time while instructing can be uncomfortable for the instructor.

Another technique used by instructors is to attach a tether to the beginner, e.g., via a harness worn by the beginner, and ski/snowboard behind the beginner with the tether in hand. The tether permits the instructor to brake the beginner from behind if the beginner accelerates out of control, but may throw the beginner off balance. Further, insofar as the tether pulls the beginner's weight backwards to stop or slow down the beginner such that the beginner rocks back on his/her heels, the beginner is learning improper form for stopping or controlling their speed if the beginner is using skis.

Yet another technique used by instructors is to walk or ski/snowboard along the side of a beginner and attempt to physically hold up the beginner to teach the beginner the balance needed to control the skis or snowboard. This scenario often results in the beginner and sometimes both the beginner and the instructor falling many times until the balance is learned. This technique can be difficult since the instructor must run or ski/snowboard after the beginner to catch up when the beginner starts moving on their own. This and the other techniques of instruction described above are flawed in that the instructor is typically attempting to control the beginner's skis/snowboard by holding on to the beginner's body, either directly or via a tether.

The subject matter claimed herein is not limited to embodiments that solve any disadvantages or that operate only in environments such as those described above. Rather, this background is only provided to illustrate one exemplary technology area where some embodiments described herein may be practiced

BRIEF SUMMARY OF SOME EXAMPLE EMBODIMENTS

In general, example embodiments of the invention relate to an apparatus for teaching a student to ski or snowboard.

In one example embodiment, an apparatus for teaching a student how to ski or snowboard includes a removably attachable instructor component, a removably attachable student component, and means for temporarily securing the instructor component and student component together. The instructor component has a first end defining a cavity configured to receive a bottom end of an instructor's ski pole and a second end disposed opposite the first end. The student component has a first end configured to attach to a portion of a student's ski or snowboard equipment and a second end disposed opposite the first end.

In another example embodiment, an instructor component for use by an instructor in teaching a student how to ski or snowboard includes a first end, a second end, and means for temporarily securing the instructor component to a bottom end of an instructor's ski pole. The first end defines a cavity configured to receive the bottom end of the instructor's ski pole. The second end is disposed opposite the first end and includes means for temporarily securing the instructor component to a student's ski or snowboard equipment.

In yet another example embodiment, a student component for use by a student in learning how to ski or snowboard includes means for removably attaching the student component to a portion of a student's ski or snowboard equipment. The student component further includes means for temporarily securing the student component to a corresponding instructor component, the instructor component being removably attached to a bottom end of an instructor's ski pole.

These and other aspects of example embodiments will become more fully apparent from the following description and appended claims.

BRIEF DESCRIPTION OF THE DRAWINGS

To further clarify various aspects of some embodiments of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the drawings to describe various aspects of some example embodiments of the invention. It is to be understood that the drawings are diagrammatic and schematic representations of such exemplary embodiments, and are not limiting of the present invention, nor are they necessarily drawn to scale.

I. First Example Embodiment

Figure 1A:
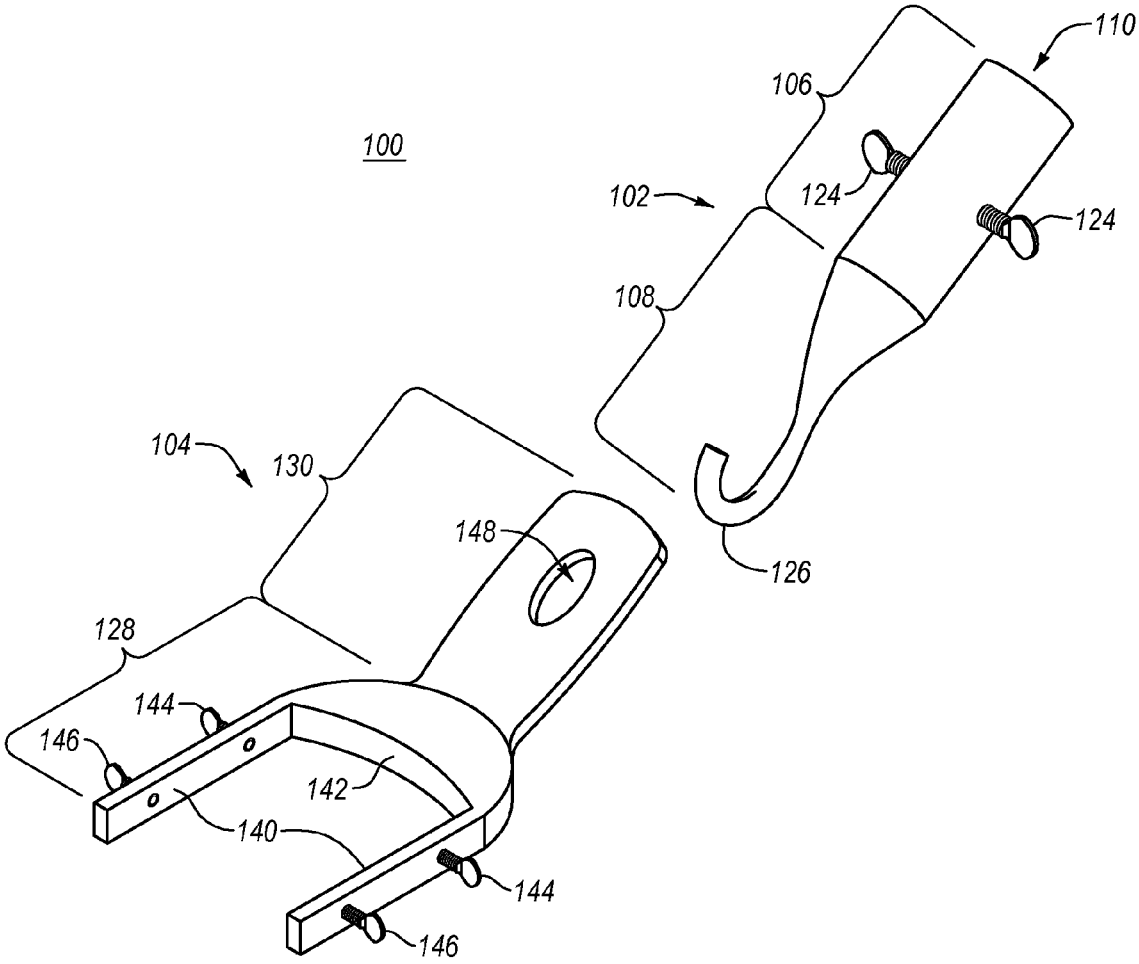
FIG. 1A is a perspective view of an example apparatus including an instructor component and a student component for teaching a student how to ski.

With reference to FIG. 1A, a first example apparatus 100 for teaching a student to snow ski is disclosed. The apparatus 100 includes an instructor component 102 and a student component 104. In general, the instructor component 102 is configured to be removably attached to a piece of instructor equipment, such as a ski pole, trekking pole, or other pole used by the instructor, and the student component 104 is configured to be removably attached to a piece of student equipment, such as one of the student's skis, a portion of a ski binding assembly, a binding plate, a boot, or the like.

As will be more fully explained below, after the instructor component 102 and student component 104 have been attached to the instructor equipment or student equipment, respectively, the instructor temporarily secures the instructor component 102 to the student component 104 to thereby control the student's ski and teach the student proper form for skiing. By using two apparatuses 100, the instructor can independently control both of the student's skis using two ski poles. As used herein, the term "instructor" refers to any person using instructor equipment with an attached instructor component 102, while the term "student" refers to any person using student equipment with an attached student component 104.

A. Instructor Component

The instructor component 102 has a first end 106 and a second end 108. With additional reference to FIG. 1B, the first end 106 defines a cavity 110 configured to receive a portion of a pole 112. Although not required, in some embodiments, the pole 112 is one of the instructor's ski poles and the cavity 110 receives at least a lower portion 114 of the pole 112 disposed beneath basket 116. It is appreciated, however, with the benefit of the present disclosure, that the pole may instead be a trekking pole or other pole with a lower end sized to be received within the cavity 110.

Figure 1B:
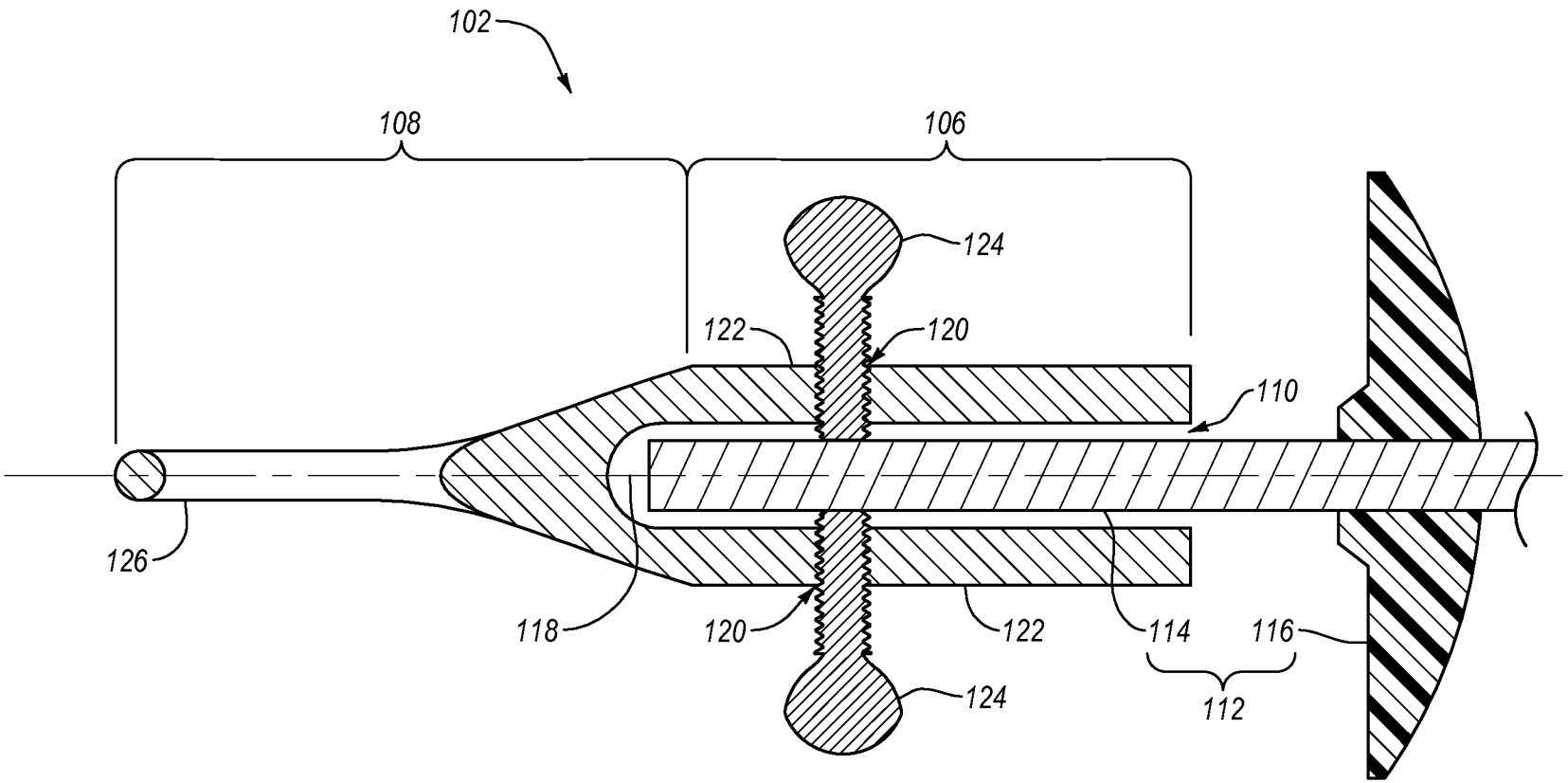
FIG. 1B is a cross-sectional view of the instructor component of FIG. 1A attached to an instructor's ski pole.

As best seen in FIG. 1B, the cavity 110 is substantially cylindrical in some embodiments and has a longitudinal axis 118. In other embodiments, the cavity 110 is substantially conical or frustoconical. When the cavity 110 is substantially cylindrical, conical, or frustoconical, a cross-section of the cavity 110 taken normal to the longitudinal axis 110 is substantially circular. Alternately, the cavity 110 is an n-sided prism, pyramid, or other shape such that a cross-section of the cavity 110 taken normal to the longitudinal axis 110 is an n-sided polygon. More generally, the cavity 110 can be any shape configured to receive the lower end 114 of the pole 112.

In the illustrated embodiment, the first end 106 further includes two tapped holes 120 formed in sidewalls 122 of the first end 106. Corresponding thumbscrews 124 are disposed within tapped holes 120 at least partially within the sidewalls 122 for temporarily securing the instructor component 102 to the pole 112. The tapped holes 120 extend radially through the sidewalls 122 towards the longitudinal axis 118 such that the thumbscrews 124 are generally disposed radially relative to the longitudinal axis 118. As such, rotation of the thumbscrews 124 within tapped holes 120 translates to radial movement of the thumbscrews 124. Specifically, the thumbscrews 124 can be screwed in (e.g., radially inwards) to secure the instructor component 102 to the pole 112, and out (e.g., radially outwards) to release the instructor component 102 from the pole 112.

The thumbscrews 124 are one example of a structural implementation of a means for temporarily securing the instructor component 102 to the pole 112. Other examples of structural implementations of means for temporarily securing the instructor component 102 to the pole 112 include as few as one thumbscrew or three or more thumbscrews disposed at least partially within sidewalls 122. Still other examples of structural implementations of means for temporarily securing the instructor component 102 to the pole 112 include one or more screws, bolts, clamps, clips, tape, carabiners, rings, pins, or other fasteners, or any combination thereof.

The second end 108 of the instructor component 102 is disposed opposite the first end 106. As best seen in FIG. 1A, the second end 108 includes a hook 126. The hook 126 is generally configured to temporarily secure the instructor component 102 to the student component 104, as explained more fully below with respect to the student component 104. Thus, the hook 126 is one example of a structural implementation of a means for temporarily securing the instructor component 102 to the student component 104. Other non-limiting examples of structural implementations of means for temporarily securing the instructor component 102 to the student component 104 include a hook, hole, ball or socket formed in the second end 108 of the instructor component 102 for engaging a corresponding hole, hook, socket or ball formed in the student component 104.

B. Student Component

In the example illustrated in FIG. 1A, the student component 104 includes a substantially u-shaped first end 128 and a second end 130 disposed opposite the first end 128. In some embodiments, the second end 130 is a tongue extending from a base of the u-shaped first end 128.

Figure 1C:
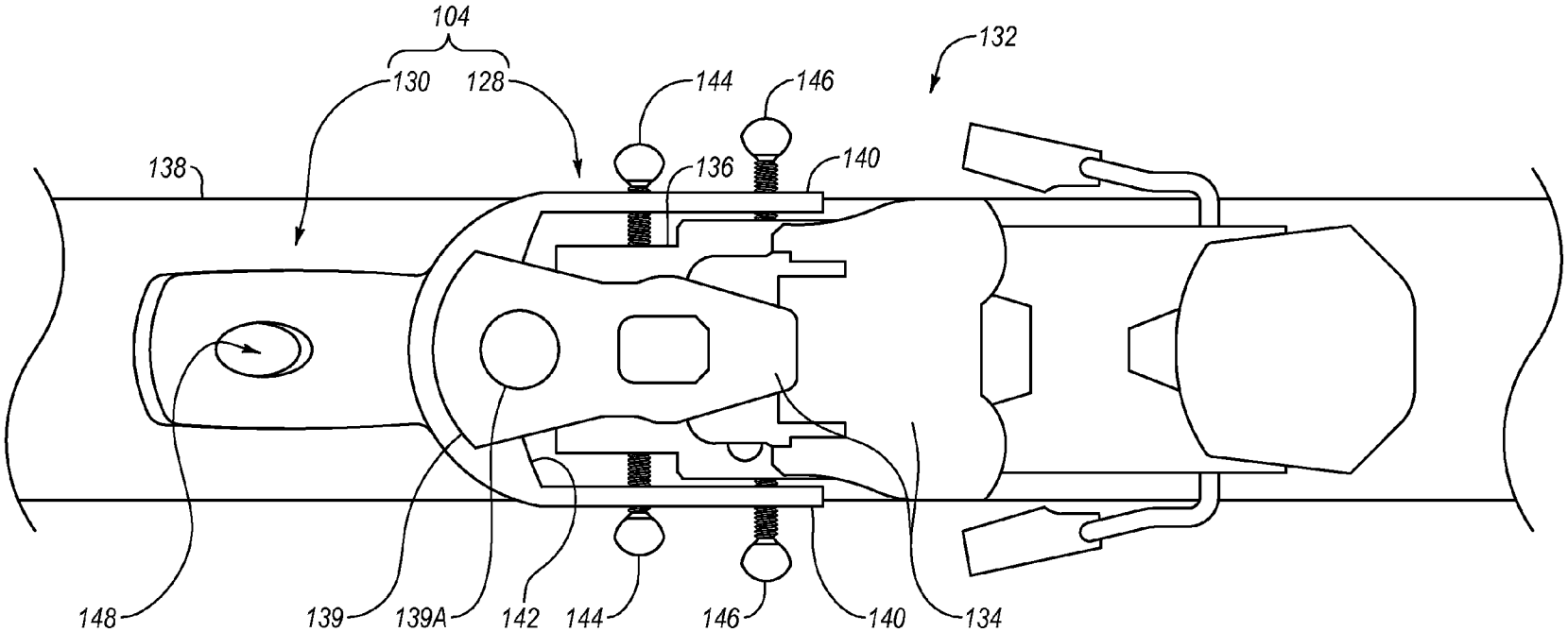
FIG. 1C is a top view of the student component of FIG. 1A attached to a student's ski binding assembly.

With additional reference to FIG. 1C, the first end 128 is configured to receive and attach to a portion of a student's ski binding assembly 132. The ski binding assembly 132 includes a heel unit 134, a toe unit (not shown) and a binding plate/spacer 136 attached to the student's ski 138.

As shown in FIG. 1C, the first end 128 of student component 104 straddles the binding plate/spacer 136 such that a portion of the bind plate/spacer 136 is received between the u-shaped first end 128. After receiving the binding plate/ spacer 136 between u-shaped first end 128, the student component 104 can be removably attached to the binding plate/spacer 136 as described in more detail below. In other embodiments, the first end 128 of student component 104 is removably attached to the heel unit 134 or other portion of the ski binding assembly 132, or directly to the ski 138. Thus, the u-shaped first end 128 is one example of a structural implementation of a means for removably attaching the student component 104 to a portion of a student's ski equipment.

The heel unit 134 may include, among other things, an upper heel housing 139 with a depression 139A formed near a rearward end thereof. The upper heel housing 139 and depression 139A are discussed in more detail with respect to FIG. 4.

One or both of the heel unit 134 or toe unit (not shown) may be adjustably positioned along the length of the ski 138 to permit adjustment and accommodation of a range of boot sizes. Notwithstanding such lengthwise adjustability, the heel unit 134 and toe unit are semi-permanently attached to the ski 138. That is, the heel unit 134 and/or toe unit are typically not configured to be detached from the ski 138 during normal usage, although under some circumstances, such as binding repair/replacement, the heel unit 134 and/or toe unit may be detached from the ski 138 with the appropriate tools and effort. Moreover, removal and/or attachment of the heel unit 134 and/or toe unit is typically performed by trained individuals with a certain amount of technical expertise to ensure proper removal/installation thereof.

The binding plate/spacer 136 is non-adjustably attached to the ski 138. Typically, the binding plate/spacer 136 is implemented to provide a mounting surface for the heel unit 104 and toe unit (not shown) that spreads stress across a larger area of the ski 138 than if the heel unit 104 and toe unit were mounted directly to the ski 138. Similar to the heel unit 104 and toe unit, the binding plate/spacer is semi-permanently attached to the ski 138.

The ski binding assembly 132 described herein is only one example of a ski binding assembly with which embodiments of the apparatus 100, including instructor component 102 and student component 104, can be implemented. Thus, the example of the ski binding assembly 132 should not be construed to limit the claimed invention.

With continued reference to FIGS. 1A and 1C, the u-shaped first end 128 of student component 104 includes two arms 140 connected by a base 142. The arms 140 are disposed substantially parallel to and apart from each other so as to straddle the binding plate/spacer 136 (or heel unit 134). Alternately or additionally, the arms 140 each include an elbow or other feature(s) such that the arms 140 are vertically displaced beneath the base 142 so as to straddle the ski 138; e.g., the base 142 would be disposed on or above the top surface of the ski 138 while a significant portion of each arm 140 is vertically displaced downwards from the base 142, the significant portions of the arms 140 extending alongside opposing sides of the ski 138.

In the illustrated embodiment of FIGS. 1A and 1C, the first end 128 further includes four tapped holes (not shown) formed in the arms 140. Corresponding rearward and forward thumbscrews 144, 146 (collectively "thumbscrews 144, 146") are at least partially disposed in the arms 140 via the tapped holes. Although not required, in the illustrated embodiment the thumbscrews 144, 146 are disposed in arms 140 substantially normal to the arms 140. Analogous to the thumbscrews 124 of instructor component 102, the thumbscrews 144, 146 of student component 104 can be rotated within the tapped holes so as to be screwed in or out for temporarily securing the student component 104 to a portion of the ski binding assembly 132 or ski 138.

By implementing thumbscrews 144, 146 within corresponding tapped holes such that the thumbscrews 144, 146 can be independently screwed in or out to varying depths, the student component 104 can be temporarily secured to portions of binding assemblies 132 notwithstanding non-planar surface topologies. For instance, in the example illustrated in FIG. 1C, the binding plate/spacer 136 is narrower towards the rear of the heel unit 134 than towards the front of the heel unit 134. To accommodate this non-planar surface topology of the binding plate/spacer 136, the rearward thumbscrews 144 are screwed in a greater amount than the forward thumbscrews 146 such that the rearward thumbscrews 144 engage the narrower rearward portion of the binding plate/spacer 136 while the forward thumbscrews 146 engage the wider forward portion of the binding plate/spacer 136.

The thumbscrews 144, 146 are one example of a structural implementation of a means for temporarily securing the student component 104 to a ski binding assembly 132 or ski 138. Other examples of structural implementations of means for temporarily securing the student component 104 to a ski binding assembly 132 or ski 138 include as few as one, two, or three thumbscrews or five or more thumbscrews disposed at least partially within arms 140. Still other examples of structural implementations of means for temporarily securing the student component 104 to a ski binding assembly 132 or ski 138 include one or more screws, bolts, clamps, clips, tape, carabiners, rings, pins, or other fasteners, or any combination thereof.

It will be appreciated, with the benefit of the present disclosure, that the configuration of the student component 104 described herein permits the student component 104 to be attached to and removed from the ski binding assembly 132 or ski 138 without removing any portion of the ski binding assembly 132. Specifically, the student component 104 can be quickly attached to or removed from the ski binding assembly 132 or ski 138 by screwing the thumbscrews 144, 146 in or out as needed, without ever removing the ski binding assembly 132 from the ski 138. Thus, at least some of the embodiments disclosed herein provide a quick, easy, and convenient method of temporarily securing the student component 104 to the ski binding assembly 132 or ski 138 which can be performed by a student and/or instructor with little or no technical expertise relating to bindings.

The second end 130 of the student component 104 is disposed opposite the first end 128. In the example of FIGS. 1A and 1C, the second end 130 extends from the base 142 of the first end 128. The second end 130 includes a hole 148 formed therein for receiving the hook 126 of the instructor component. When the hook 126 is received in the hole 148, the instructor component 102 is attached to the pole 112, and the student component 104 is attached to the ski binding assembly 132, the instructor can apply a force and have that force transferred through the pole 112, instructor component 102, student component 104 and ski binding assembly 132 to the student's ski 138 to control the direction and edging of the ski 138.

Thus, the hole 148 is one example of a structural implementation of a means for temporarily securing the student component 104 to instructor component 102. Other non-limiting examples of structural implementations of means for temporarily securing the student component 104 to the instructor component 102 include a hole, hook, socket or ball formed in the second end 130 of the student component 104 for engaging a corresponding hook, hole, ball, or socket formed in the instructor component 102.

Moreover, the hook 126 formed in the instructor component 102 and the hole 148 formed in the student component 104 are collectively one example of a structural implementation of a means for temporarily securing the instructor component 102 and student component 104 together. Other non-limiting examples of structural implementations of means for temporarily securing the instructor component 102 and student component 104 together include a hole formed in the instructor component 102 and a corresponding hook formed in the student component 104, a ball formed in the instructor component 102 and a corresponding socket formed in the student component 104, or a socket formed in the instructor component 102 and a corresponding ball formed in the student component 104.

Figure 2:
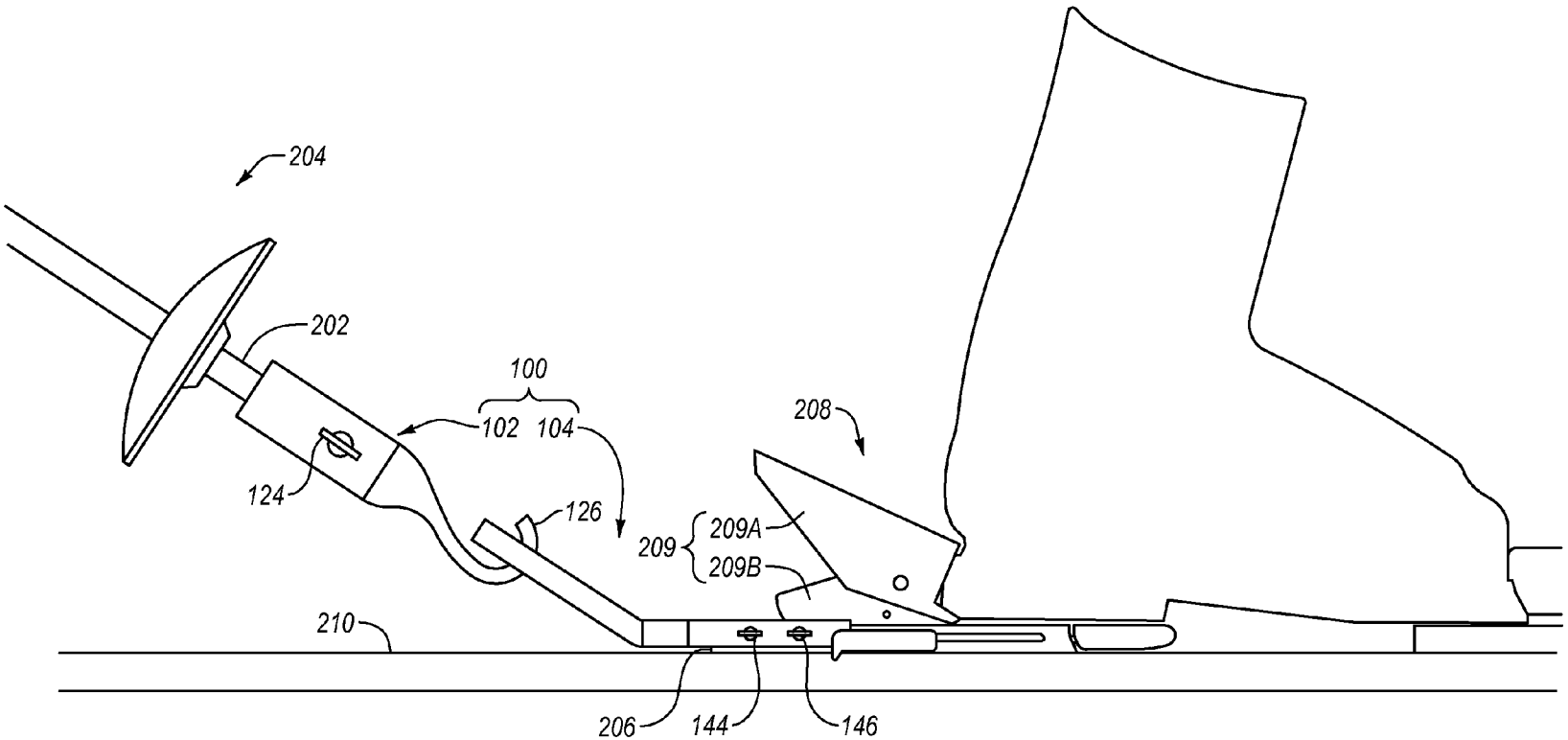
FIG. 2 is a side view illustrating an example usage scenario for the apparatus of FIG. 1A.

FIG. 2 discloses an example usage scenario for the apparatus 100 of FIGS. 1A-1C. In particular, as shown in FIG. 2, the instructor component 102 is removably secured to the lower end 202 of an instructor's ski pole 204 using one or more thumbscrews 124. The hook 126 of the instructor component 102 is removably received in the hole 148 (not shown in FIG. 2) of the student component 104. The student component 104 is removably secured to the binding plate/spacer 206 of a student's ski binding assembly 208 using thumbscrews 144, 146. The ski binding assembly 208 additionally includes a heel unit 209 made up of an upper heel housing 209A and a lower heel housing 209B. The binding plate/spacer 206 and ski binding assembly 208 are mounted to the student's ski 210.

Under the usage scenario of FIG. 2 and under analogous usage scenarios using one or more of the other embodiments described herein, the instructor can easily control the student's direction and edging by applying forces through the ski pole 204, apparatus 100 and binding plate/spacer 206 to the student's ski 210. Thus, the instructor can show the student proper ski techniques for turning, stopping, etc., by applying the appropriate forces. In this manner, the student can feel exactly how the skis 210 should be maneuvered to perform the techniques. Further, the length of the instructor's ski pole 210 permits the instructor to demonstrate the proper techniques to the student without the instructor being forced to crouch over significantly, even when the student is physically small in stature compared to the instructor.

According to some embodiments, the apparatus 100 also permits the student to ski substantially under his/her own control without assistance from the instructor. For instance, the instructor can simply let go of the ski poles 204 while the instructor component 102 is still connected to the student component 104 and allow the ski poles 204 to be dragged behind the student. Leaving the ski poles 204 connected to the student via apparatus 100 permits the instructor to almost immediately resume control at any time by simply picking up the ski poles 204.

Alternately, the instructor can remove the hook 126 of the instructor component 102 from the hole 148 (not shown in FIG. 2) of the student component 104 by sliding the hook 126 out of the hole 148 to completely detach the ski poles 204 from the student and allow the student to ski under his/her own control. Of course, the ability to easily and quickly slide the hook 126 out of the hole 148 also permits the instructor to wait until the instructor and student are on the loading platform of a ski chairlift (or tow rope) before detaching the ski poles 204 from the student. As such, if necessary, the instructor can keep the ski poles 204 connected to the student while navigating through the lift line to push the student through the lift line using the ski poles 204. After getting to the top of the chairlift and dismounting from the chair, the ski poles 204 can easily and quickly be re-attached to the student by inserting the hook 126 of instructor component 102 into the hole 148 of student component 104.

Alternately or additionally, the instructor can use the ski poles 204 connected to the student via apparatus 100 to push the student across flat areas or uphill areas where the student might otherwise have to skate or use the student's own poles to propel him/herself forward. Such a use of the apparatus 100 may be helpful for students, such as young students or other students, that lack the coordination to skate using their skis and/or that are skiing without poles.

II. Alternative Embodiments

The apparatus 100 described above with respect to FIGS. 1A-2 is described by way of example only and not limitation. Numerous variations and modifications of one or both of the instructor component 102 or student component 104 fall within the scope of the claimed invention.

Figure 3:
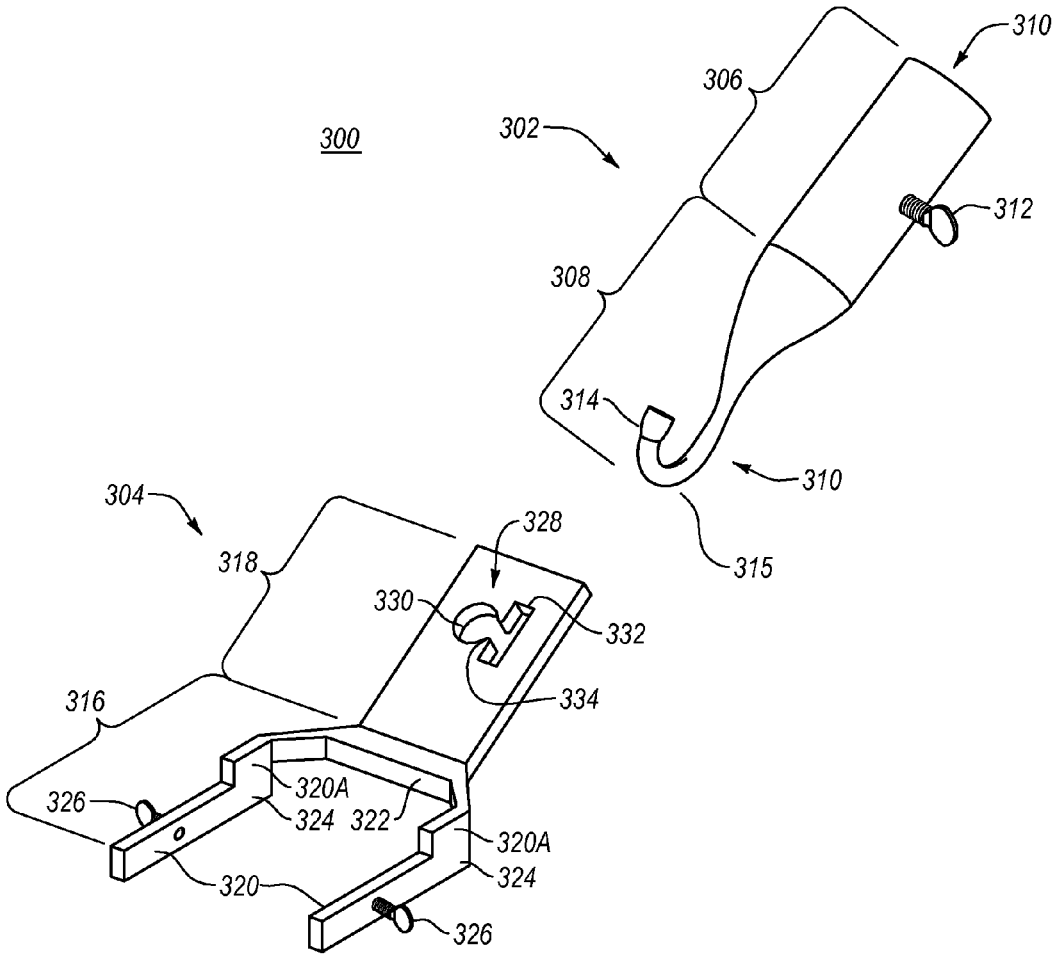
FIG. 3 is a perspective view of another example apparatus including another instructor component and student component that can be implemented according to some embodiments.

For example, FIG. 3 discloses another embodiment of an apparatus 300 that is similar in some respects to the apparatus 100 disclosed above. The apparatus 300 includes an instructor component 302 and student component 304 that are substantially similar in function to the instructor component 102 and student component 104 of FIGS. 1A-1C. In particular, the instructor component 302 is configured to removably attach to a piece of instructor equipment, e.g., an instructor's ski pole, the student component 304 is configured to removably attach to a piece of student equipment, e.g., the student's ski, and the instructor component 302 is further configured to be temporarily secured to the student component 304 to permit the instructor to control the student's skis via the instructor's ski poles and the apparatus 300.

Similar to the instructor component 102, the instructor component 302 of FIG. 3 includes a first end 306 and a second end 308 disposed opposite the first end 306, the second end 308 including a hook 310. In comparison with the instructor component 102, the instructor component 302 includes only a single thumbscrew 312 partially disposed within a sidewall of the first end 306 for temporarily securing the instructor component 302 to a portion of the instructor's pole. The thumbscrew 312 is another example of a structural implementation of a means for temporarily securing an instructor component 302 to a bottom end of an instructor's ski pole.

In the illustrated example of FIG. 3, the hook 310 includes an enlarged portion 314 disposed on the end of a neck 315 which is narrower in diameter than the enlarged portion 314, aspects of which are described in additional detail below. The hook 310 is another example of a structural implementation of a means for temporarily securing the instructor component 302 to a corresponding student component 304.

Similar to the student component 104, the student component 304 of FIG. 3 includes a substantially u-shaped first end 316 and a second end 318 disposed opposite the first end 316. The u-shaped first end 316 includes two arms 320 connected by a base 322, the arms 320 being disposed substantially parallel to and apart from each other. In comparison with the student component 104, the arms 320 are vertically displaced beneath the base 322 via upper arm portions 320A and elbows 324. Accordingly, the student component 304 can be attached to a student's ski by placing the base 322 on a top surface of the ski with the arms 320 being displaced vertically downwards beneath the base 322 such that the arms 320 straddle the ski and run along its sides. The u-shaped first end 316 of FIG. 3 is another example of a structural implementation of a means for removably attaching a student component 304 to a portion of a student's ski equipment (e.g., the student's skis).

Additionally, the student component 104 includes only two tapped holes (not labeled) and two corresponding thumbscrews 326 for temporarily securing the student component 304 to the student's ski, as compared to four tapped holes and four corresponding thumbscrews 144, 146 in the student component 104 illustrated in FIG. 1A. The thumbscrews 326 are another example of a structural implementation of a means for temporarily securing a student component 304 to a portion of a student's ski equipment.

Moreover, the second end 318 of student component 304 includes a hole 328 formed therein, the hole 328 having a specialized shape. In particular, the hole 328 includes a hook insertion portion 330 connected to a hook locking portion 332 via a neck portion 334. Generally, the hook insertion portion 330 is sufficiently large to receive the enlarged portion 314 of the hook 310. The hook locking portion 332 and neck portion 334 are sufficiently large to accommodate the neck 315 of the hook 310, but not the enlarged portion 314 of the hook 310. In operation, to connect the instructor component 302 to the student component 304, the enlarged portion 314 of the hook is fully inserted through the hook insertion portion 330 of hole 328. After the enlarged portion 314 has cleared the hook insertion portion 330, the neck 315 of the hook 310 is navigated through the neck portion 334 and into the hook locking portion 332 of the hole 328. Because the enlarged portion 314 is too large to exit through the hook locking portion 332 or neck portion 334, it is unlikely that the instructor component 302 will inadvertently detach from the student component 304 if, for instance, the instructor drops the instructor's ski poles to drag behind the student's skis.

The hole 328 is another example of a structural implementation of a means for temporarily securing a student component 304 to a corresponding instructor component 302. Moreover, the hook 310 and hole 328 are collectively another example of a structural implementation of a means for temporarily securing an instructor component 302 and student component 304 together.

Figure 4:
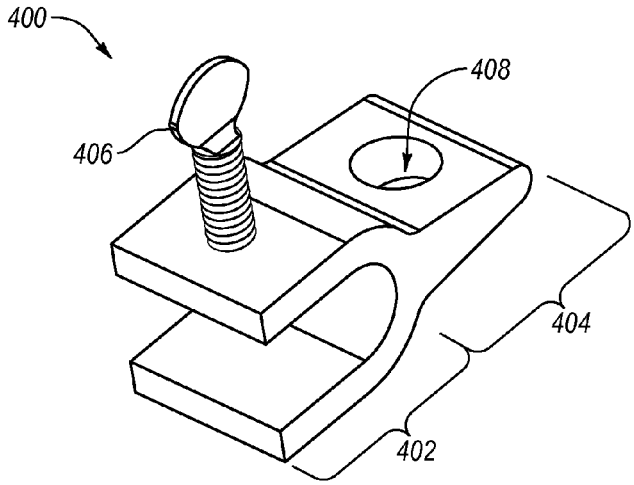
FIG. 4 is a perspective view of another student component that can be implemented according to some embodiments in an apparatus for teaching a student how to ski.

FIG. 4 discloses another embodiment of a student component 400 that can be implemented in an apparatus such as the apparatus 100 of FIG. 1A in place of student component 104. The student component 400 includes a substantially u-shaped first end 402 and a second end 404 disposed opposite the first end 402. The student component 400 further includes a tapped hole (not shown) in the first end 402 within which a thumbscrew 406 is at least partially disposed, and a hole 408 formed in the second end 404. The thumbscrew 406 is another example of a structural implementation of a means for temporarily securing a student component 400 to a portion of a student's ski equipment. The hole 408 is another example of a structural implementation of a means for temporarily securing a student component 400 to a corresponding instructor component.

The student component 400 is configured to removably attach to a portion of the student's equipment, such as to the heel unit of the student's skis. For instance, with combined reference to FIG. 1C and FIG. 4, the student component 400 can be removably attached to the upper heel housing 139 of heel unit 134 by positioning the rearward end of the upper heel housing 139 within the u-shaped opening of the first end 402 of the student component 400 such that the bottom end of the thumbscrew 406 is located substantially above the depression 139A. The thumbscrew 406 can then be screwed in to engage the depression 139A and thereby temporarily secure the student component 400 to the heel unit 134 for use with an instructor component, such as instructor components 102, 302 of FIGS. 1A and 3. As another example, the student component 400 can alternately or additionally be removably attached to the rearward end of the upper heel housing 209A of FIG. 2. Accordingly, the u-shaped first end 402 is another example of a structural implementation of a means for removably attaching a student component 400 to a portion of a student's ski or snowboard equipment.

Figure 5A:
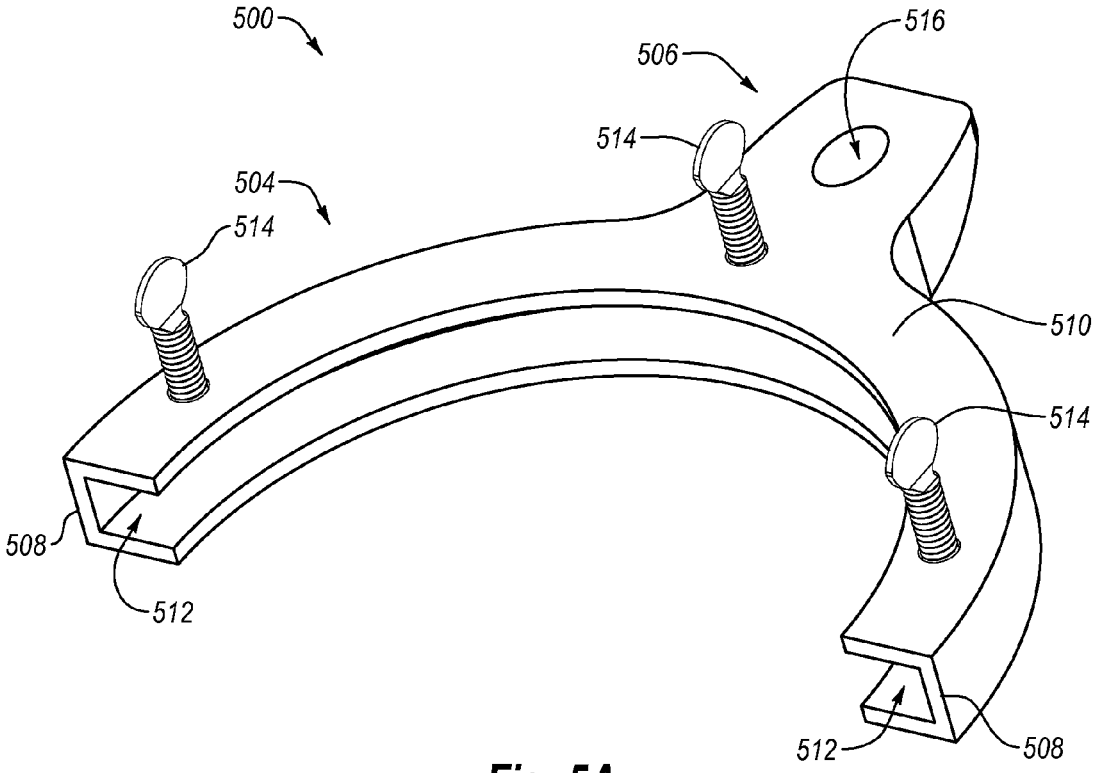
FIG. 5A is a perspective view of yet another student component that can be implemented according to some embodiments in an apparatus with an instructor component for teaching a student how to snowboard.
Figure 5B:
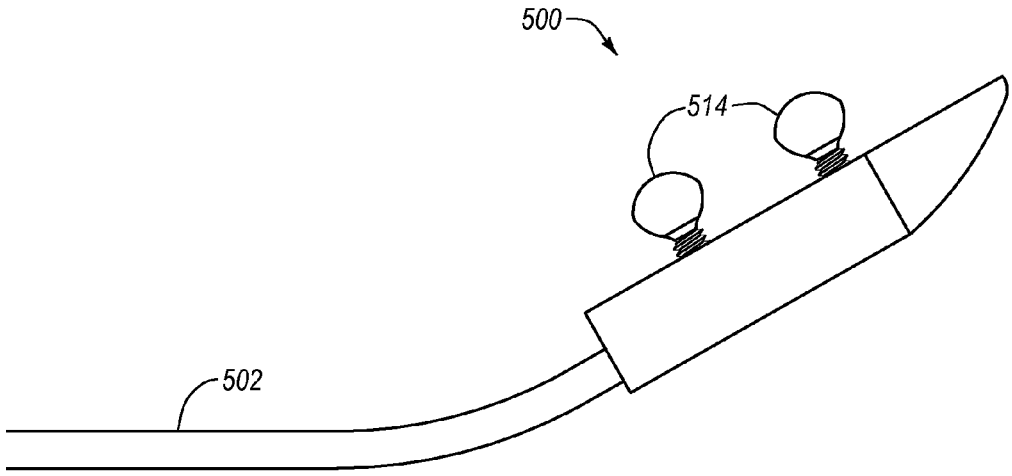
FIG. 5B is a side view illustrating an example usage scenario for the student component of FIG. 5A.

FIGS. 5A and 5B disclose yet another embodiment of a student component 500 that can be implemented in an apparatus such as the apparatus 100 of FIG. 1A in place of student component 104. In contrast to the student components 104, 304, 400 described above, which are generally configured for removably attaching to ski equipment, the student component 500 of FIG. 5 is configured for removably attaching to snowboard equipment. Specifically, the student component 500 is configured to be removably attached to the end of a snowboard 502 (FIG. 5B).

In the illustrated embodiment, the student component 500 includes a substantially u-shaped first end 504 and a second end 506 disposed opposite the first end 504. The first end 504 includes two arms 508 connected by a base 510. A substantially u-shaped channel 512 is formed along the interior of the u-shaped first end 504, the channel 512 being configured to receive a perimeter portion of an end of the snowboard 502. After positioning the perimeter portion of the end of the snowboard 502 within the channel 512, thumbscrews 514 disposed within tapped holes (not shown in FIG. 5A or 5B) formed in the first end are screwed in to removably attach the student component 500 to the snowboard 502. Accordingly, the u-shaped first end 504 is an example of a structural implementation of a means for removably attaching a student component 500 to a portion of a student's snowboard equipment, while the thumbscrews 514 are an example of a structural implementation of a means for temporarily securing a student component 500 to a portion of a student's snowboard equipment.

The second end 506 of student component 500 includes a hole 516 formed therein for removably receiving a corresponding hook, such as the hook 126, on an instructor component attached to an instructor's pole. The hook can be inserted through the hole 516 to permit the instructor to control the direction and edging of the student's snowboard 502. The hole 516 formed in the second end 506 of student component 500 is another example of a structural implementation of a means for temporarily securing a student component 500 to a corresponding instructor component.

Figure 6A:
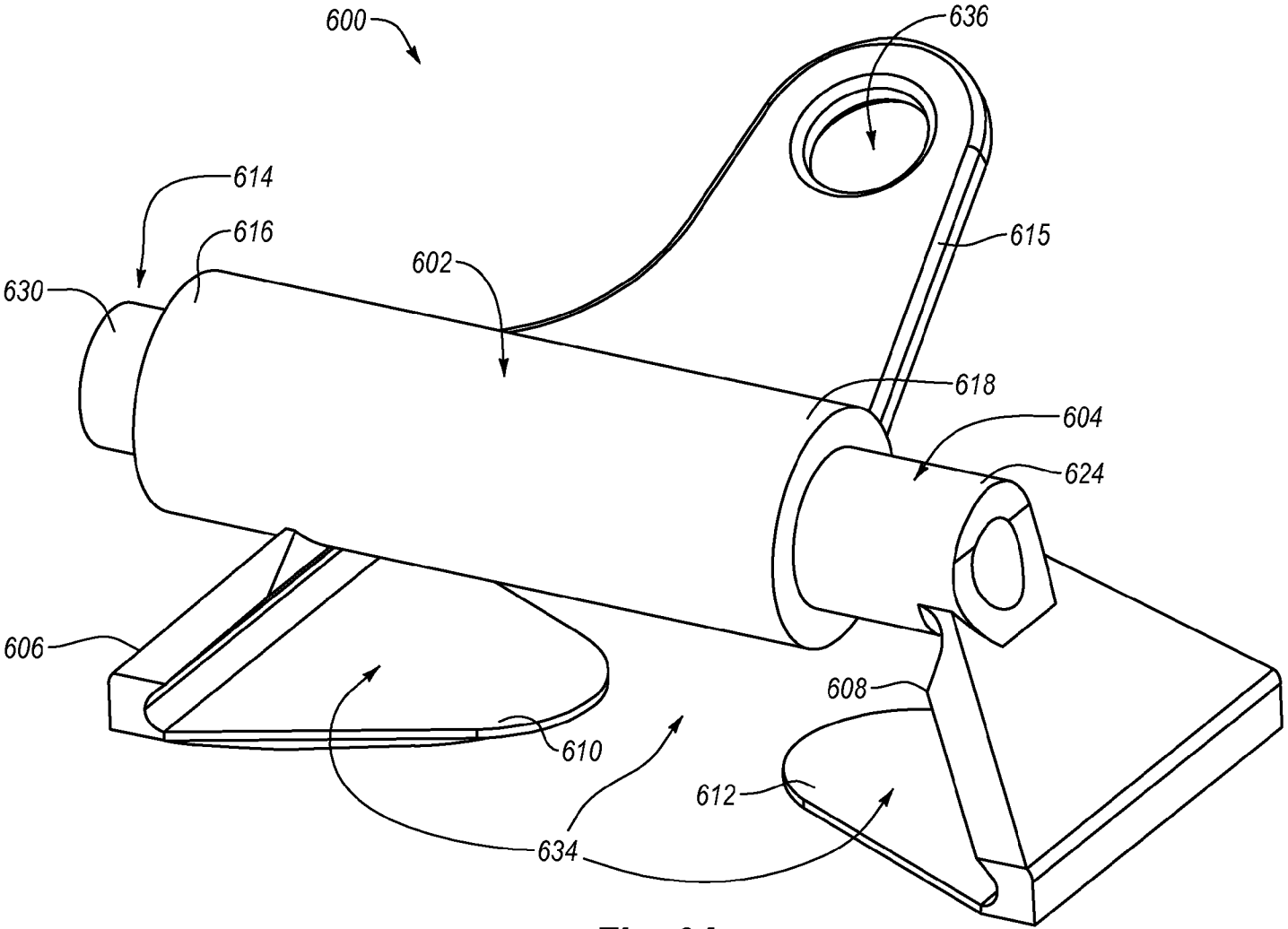
FIGS. 6A and 6B are a perspective view and an exploded perspective view of yet another student component that can be implemented according to some embodiments in an apparatus for teaching a student how to ski.
Figure 6B:
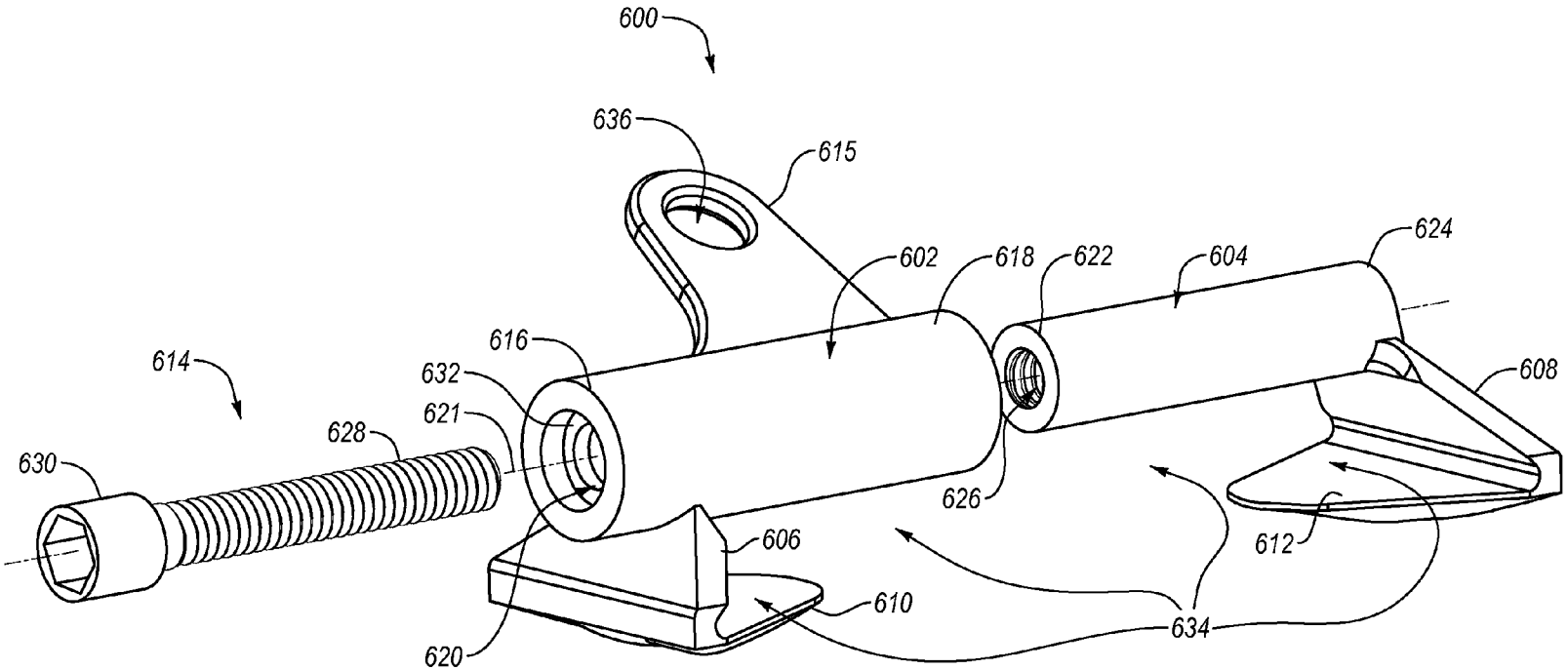

FIGS. 6A and 6B disclose yet another embodiment of a student component 600 that can be implemented in an apparatus such as the apparatus of FIG. 1A in place of student component 104, the student component 600 being configured to removably attach to a student's ski. The student component 600 includes a first barrel 602, a second barrel 604, first leg 606, second leg 608, first foot 610, second foot 612, threaded fastener 614, and tongue 615.

The first barrel 602 includes opposing first and second ends 616, 618 with a hollow interior 620 (FIG. 6B) extending therebetween. The hollow interior 620 defines a longitudinal axis 621 (FIG. 6B). When the student component 600 is removably attached to a student's ski, the longitudinal axis 620 is arranged substantially normal to a length of the student's ski according to some embodiments.

The second barrel 604 includes opposing first and second ends 622 (FIG. 6B), 624 with a threaded hollow interior 626 (FIG. 6B) extending therebetween. The second barrel 604 is slidably received within the hollow interior 620 of the first barrel 602. The threaded hollow interior 626 of the second barrel 604 is configured to receive a threaded end 628 of the threaded fastener 614.

The threaded fastener 614 is configured to adjustably secure the second barrel 604 within the hollow interior 620 of the first barrel 602. To this end, the threaded end 628 of threaded fastener 614 is configured to be inserted from the first end 616 of first barrel 602 through the hollow interior 620 of the first barrel 602 and into the threaded hollow interior 626 of the second barrel 604, whereupon external threads of the threaded end 628 engage corresponding internal threads of the threaded hollow interior 626. The threaded fastener 614 includes a head 630 that engages a shoulder 632 formed in the hollow interior 620 of the first barrel 602. It will be appreciated, with the benefit of the present disclosure, that after engaging the second barrel 604, the threaded fastener 614 can be screwed in or out to draw the second barrel 604 further into or out of the hollow interior 620 of the first barrel 602.

The first foot 610 is attached to and separated from the first end 616 of the first barrel 602 by the first leg 606. Analogously, the second foot 612 is attached to and separated from the second end 624 of the second barrel 604 by the second leg 608. The first foot 610 extends from the first leg 606 towards the second foot 612 in a direction substantially parallel to the longitudinal axis 621. The second foot 612 similarly extends from the second leg 608 towards the first foot 610 in a direction substantially parallel to the longitudinal axis 621. The first and second barrels 602, 604, first and second legs 606, 608, first and second feet 610, 612 and threaded fastener 614 define an adjustable aperture 634 configured to receive therethrough a student's ski. The adjustability of the aperture 634 permits the student component 600 to be removably attached to student skis having a wide range of widths. Moreover, the first barrel 602, second barrel 604, first and second legs 606, 608, first and second feet 610, 612 and threaded fastener 614 are collectively another example of a structural implementation of a means for removably attaching a student component 600 to a portion of a student' ski.

The tongue 615 includes a hole 636 formed therein for removably receiving a corresponding hook, such as the hook 126 of FIG. 1A, on an instructor component attached to an instructor's pole. The hook can be inserted through the hole 636 to permit the instructor to control the direction and edging of the student's ski. The hole 636 is another example of a structural implementation of a means for temporarily securing a student component 600 to a corresponding instructor component.

It will be appreciated, with the benefit of the present disclosure, that the embodiments disclosed in FIGS. 1A-6B are not mutually exclusively and can be combined in a number of ways that fall within the scope of the claims. For example, rather than including a hole 148, 408, 516, 636 that is substantially circular, each of student components 104, 400, 500, 600 of FIGS. 1A and 4-6B can instead implement a hole with a specialized shape, such as the hole 328 of FIG. 3, such that the student components 104, 400, 500, 600 can be used with the instructor component 302 of FIG. 3. Alternately or additionally, instructor component 102 or 302 can be implemented with either of student components 104, 304, 400, 500, 600 in an apparatus for teaching a student how to ski or snowboard.

III. General Aspects of Some Example Embodiments

As already explained above with respect to FIG. 2, embodiments of the instructor component 102, 302 and/or student component 104, 304, 400, 500, 600 permit an instructor to control the direction and edging of a student's ski or snowboard. As such, the instructor can show the student proper ski or snowboard techniques for turning, stopping, etc., by applying the appropriate forces. In this manner, the student can feel exactly how the student's skis or snowboard should be maneuvered to perform the techniques. Further, the length of the instructor's pole permits the instructor to demonstrate the proper techniques to the student without the instructor being forced to crouch over, even if the student is physically small in stature compared to the instructor.

Alternately or additionally, embodiments of the instructor component 102, 302 and/or student component 104, 304, 400, 500, 600 permit the student to ski or snowboard substantially under his/her own control without assistance from the instructor if the instructor drops the poles and lets them drag behind the student, or if the instructor completely detaches the poles from the student. Alternately or additionally, embodiments of the instructor component 102, 302 and/or student component 104, 304, 400, 500, 600 permit the instructor to push the student through lift lines using the poles all the way to the loading platform before quickly detaching the poles from the student, or to push the student across flat areas or uphill areas.

The instructor components 102, 302 and/or student components 104, 304, 400, 500, 600 can be made from any of a variety of materials. For example, the instructor components 102, 302 and/or student components 104, 304, 400, 500, 600 can be made from steel, stainless steel, aluminum, ABS plastic, zinc-based alloys, fiberglass, carbon fiber, or other suitable material(s). Alternately or additionally, the instructor components 102, 302 and/or student components 104, 304, 400, 500, 600 may be made from a combination of two or more of the foregoing materials and/or other suitable materials. For instance, the instructor components 102, 302 and/or student components 104, 304, 400, 500, 600 may be made from composite materials such as injected plastic reinforced with steel.

Some embodiments of the invention include systems made up of an apparatus for teaching a student how to ski, such as the apparatus 100 or 300, and a device for keeping a student's ski tips together to help the student maintain balance, control wedge position and/or eliminate the spreading or crossing of the ski tips while skiing. Devices for keeping a student's ski tips together include devices marketed under the Edgie Wedgie® trademark, as well as various devices marketed by the Lucky Bums company under the names "Easy Wedge" and "Tip Clip Ski Tip Connector". Generally, such devices include a connecting member, such as a cable, rope, strap, wire, or the like, with first and second and ski tip fasteners coupled to first and second ends of the connecting member. The ski tip fasteners connect to the student's ski tips such that the connecting member substantially prevents the ski tips from spreading apart from or crossing each other. A connecting member with first and second ski tip fasteners coupled to first and second ends of the connecting member are collectively an example of a structural implementation of a means for holding tips of a student's skis together.

The embodiments disclosed herein are not limited to apparatuses having an instructor component 102, 302 in combination with a corresponding student component 104, 304, 400, 500, 600, but also extend to instructor components 102, 302 and student components 104, 304, 400, 500, 600 individually. According to some embodiments, an instructor component for use by an instructor in teaching a student how to ski or snowboard generally includes a first end defining a cavity configured to receive a bottom end of an instructor's ski pole; a second end disposed opposite the first end, the second end including means for temporarily securing the instructor component to a student's ski or snowboard equipment; and means for temporarily securing the instructor component to the bottom end of the instructor's ski pole.

The instructor component can be temporarily secured to the student's ski equipment through a student component or directly to the student's ski or snowboard equipment. As such, the means for temporarily securing the instructor component to the student's ski or snowboard equipment can include, e.g., a hook, hole, ball or socket for engaging a corresponding hole, hook, socket or ball formed in a student component removably attached to the student's ski or snowboard equipment.

Figure 7A:
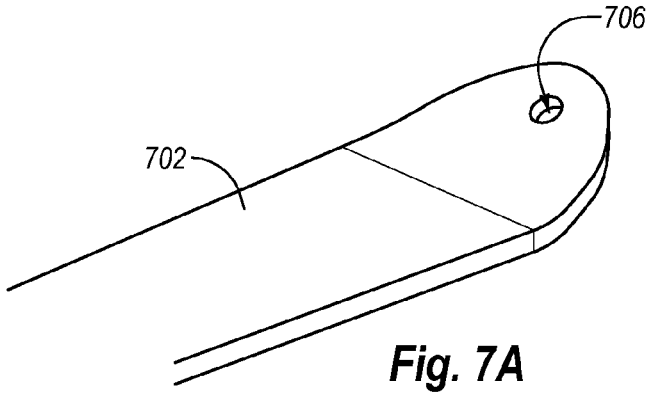
FIGS. 7A and 7B are perspective views of a ski and snowboard, respectively, with a hole formed in an end thereof for being temporarily engaged by an instructor component such as the instructor components of FIGS. 1A and 3.
Figure 7B:
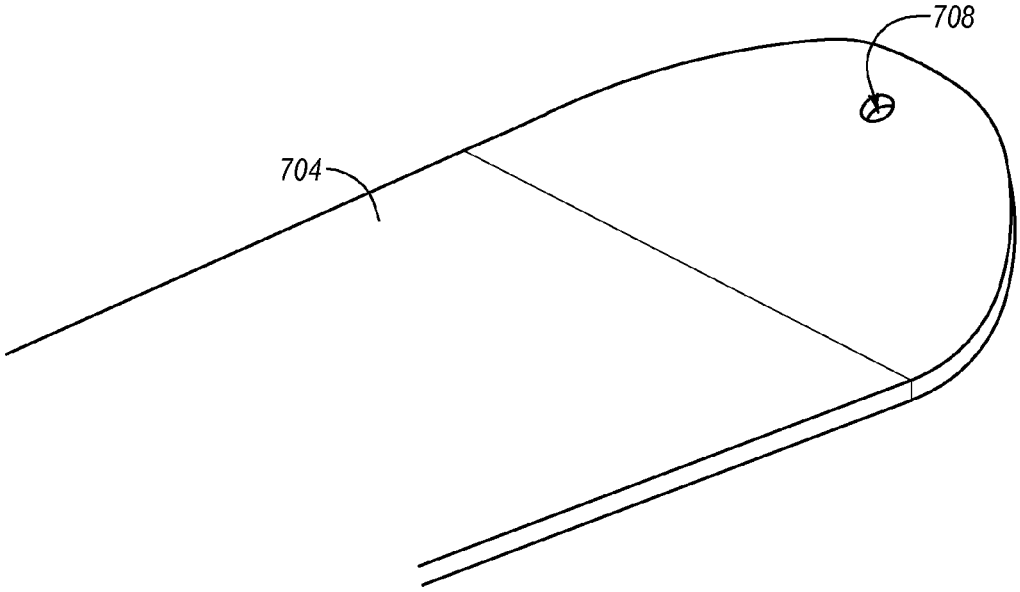

Alternately, the means for temporarily securing the instructor component to the student's ski or snowboard equipment can include, e.g., a hook, hole, ball or socket for engaging a corresponding hole, hook, socket or ball formed in the student's ski or snowboard equipment. For example, FIGS. 7A and 7B disclose, respectively, a ski 702 and a snowboard 704, each including a hole 706, 708 formed in a rearward end of the ski 702 or snowboard 704. In this example, an instructor component, such as instructor component 102, 302, can be temporarily secured to the ski 702 or snowboard 704 by inserting the hook 126, 310 into the hole 706 or 708. Alternately, the ski 702 or snowboard 704 can include a hook, socket or ball formed therein for being engaged by a corresponding hole, ball or socket formed in the second end of the instructor component. Alternately or additionally, a hook, hole, ball or socket formed in the second end of the instructor component can engage a hole, hook, socket or ball formed in a corresponding ski binding assembly mounted on the ski 702, or in a ski boot, or in a corresponding snowboard binding mounted on the snowboard 704, or in a snowboard boot, or the like or any combination thereof.

Alternately or additionally, some embodiments include a student component for use by a student in learning how to ski or snowboard. According to these and other embodiments, the student component generally includes means for removably attaching the student component to a portion of a student's ski or snowboard equipment, and means for temporarily securing the student component to a corresponding instructor component, the instructor component being removably attached to a bottom end of an instructor's ski pole.

The means for removably attaching the student component to a portion of a student's ski or snowboard equipment can include, for instance, a substantially u-shaped first end configured to attach to a student's ski, ski binding assembly, ski boot, or snowboard, such as first ends 128, 316, 402, 504 of the student components 104, 304, 400, 500 disclosed above. Alternately or additionally, the means for removably attaching the student component to a portion or a student's ski or snowboard equipment can include, for example, the first and second barrels 602, 604, first and second legs 606, 608, first and second feet 610, 612 and threaded fastener 630 of the student component 600.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for teaching a student to ski or snowboard, the apparatus comprising:

a removably attachable instructor component having a first end defining a cavity configured to receive a bottom end of an instructor's ski pole and a second end disposed opposite the first end;

a removably attachable student component having a first end configured to attach to a portion of a student's ski or snowboard equipment and a second end disposed opposite the first end; and means for temporarily securing the instructor component and student component together;

wherein:

the first end of the student component comprises:

a first barrel having opposing first and second ends with a hollow interior extending therebetween;

a second barrel having opposing first and second ends with a hollow interior extending therebetween, the second barrel being slidably received within the hollow interior of the first barrel;

a first foot attached to and separated from the first end of the first barrel by a first leg;

a second foot attached to and separated from the second end of the second barrel by a second leg; and a threaded fastener configured to adjustably secure the second barrel within the hollow interior of the first barrel, wherein the first and second barrels, first and second feet, first and second legs, and threaded fastener define an adjustable aperture configured to receive therethrough a student's ski; and the second end of the student component comprises a tongue attached to the first barrel, wherein the means for temporarily securing the instructor component and student component together comprises a hole, hook, socket or ball formed in the tongue and a corresponding hook, hole, ball or socket, respectively, formed in the second end of the instructor component.

2. The apparatus of claim 1, wherein the means for temporarily securing the instructor component and student component together comprises a hook formed in the second end of the instructor component and a hole formed in the second end of the student component, the hole being configured to receive the hook.

3. The apparatus of claim 1, wherein the instructor component comprises at least one of: steel, stainless steel, aluminum, ABS plastic, a zinc-based alloy, fiberglass, or carbon fiber.

4. The apparatus of claim 1, wherein the student component comprises at least one of: steel, stainless steel, aluminum, ABS plastic, a zinc-based alloy, fiberglass, or carbon fiber.

5. The apparatus of claim 1, further comprising means for temporarily securing the instructor component to the bottom end of the instructor's ski pole.

6. The apparatus of claim 5, wherein the cavity defined by the first end of the instructor component has a longitudinal axis and the means for temporarily securing the instructor component to the bottom end of the instructor's ski pole comprises at least one thumbscrew at least partially disposed within a sidewall of the first end of the instructor component and arranged substantially normal to the longitudinal axis.

7. The apparatus of claim 1, further comprising means for temporarily securing the student component to the portion of the student's ski or snowboard equipment.

8. The apparatus of claim 1, wherein the hollow interior of the second barrel has internal threads that are complementary to external threads of the threaded fastener, such that the threaded fastener is configured to threadably engage the second barrel to adjustably secure the second barrel within the hollow interior of the first barrel.

9. The apparatus of claim 1, wherein the first foot extends from the first leg towards the second foot in a direction substantially parallel to a longitudinal axis defined by the hollow interior of the first barrel, and the second foot extends from the second leg towards the first foot in a direction substantially parallel to the longitudinal axis.

10. A system for teaching a student how to ski, the system comprising:

an apparatus comprising:

a removably attachable instructor component having a first end defining a cavity configured to receive a bottom end of an instructor's ski pole and a second end disposed opposite the first end;

a removably attachable student component having a first end configured to attach to a portion of a student's ski or snowboard equipment and a second end disposed opposite the first end; and means for temporarily securing the instructor component and student component together;

wherein:

the first end of the student component comprises:

a first barrel having opposing first and second ends with a hollow interior extending therebetween;

a second barrel having opposing first and second ends with a hollow interior extending therebetween, the second barrel being slidably received within the hollow interior of the first barrel;

a first foot attached to and separated from the first end of the first barrel by a first leg;

a second foot attached to and separated from the second end of the second barrel by a second leg; and a threaded fastener configured to adjustably secure the second barrel within the hollow interior of the first barrel, wherein the first and second barrels, first and second feet, first and second legs, and threaded fastener define an adjustable aperture configured to receive therethrough a student's ski;

the second end of the student component comprises a tongue attached to the first barrel, wherein the means for temporarily securing the instructor component and student component together comprises a hole, hook, socket or ball formed in the tongue and a corresponding hook, hole, ball or socket, respectively, formed in the second end of the instructor component; and the student's ski or snowboard equipment includes two skis; and means for holding tips of the student's skis together.

11. The system of claim 10, wherein the means for holding tips of the student's skis together comprises a connecting member with first and second ski tip fasteners coupled to first and second ends of the connecting member, the first and second ski tip fasteners being removably attachable to the tips of the student's skis.

12. A student component for use by a student in learning how to ski or snowboard, the student component comprising:

means for removably attaching the student component to a portion of a student's ski or snowboard equipment; and means for temporarily securing the student component to a corresponding instructor component, the instructor component being removably attached to a bottom end of an instructor's ski pole:

wherein the means for removably attaching the student component to a portion of a student's ski or snowboard equipment comprises:

a first component having opposing first and second ends with a hollow interior extending therebetween, the hollow interior defining a longitudinal axis arranged substantially normal to a length of a student's ski when the student component is removably attached to the student's ski;

a second component having opposing first and second ends with a hollow interior extending therebetween, the second component being slidably received within the hollow interior of the first component with at least the second end of the second component being disposed outside the hollow interior;

a first foot attached to and separated from the first end of the first component by a first leg, a second foot attached to and separated from the second end of the second component by a second leg; and a threaded fastener configured to adjustably secure the second component within the hollow interior of the first component, wherein the first and second components, first and second feet, first and second legs, and threaded fastener define an adjustable aperture configured to receive therethrough a student's ski.

13. The student component of claim 12, wherein the means for temporarily securing the student component to the instructor component includes a hook or a hole formed in a tongue attached to the first component substantially normal to the longitudinal axis, the hook or the hole being configured to engage a corresponding hole or hook, respectively, formed in the instructor component.

14. The student component of claim 12, wherein the hollow interior of the second component has internal threads that are complementary to external threads of the threaded fastener, such that the threaded fastener is configured to threadably engage the second component to adjustably secure the second component within the hollow interior of the first component.

15. The student component of claim 14, wherein the threaded fastener includes a head and a threaded end disposed opposite the head, the threaded end including the external threads, the head configured to engage a shoulder formed in the hollow interior of the first component when the external threads in the threaded end threadably engage the internal threads of the second component.

16. The student component of claim 12, wherein the first foot extends from the first leg towards the second foot in a direction substantially parallel to the longitudinal axis and the second foot extends from the second leg towards the first foot in a direction substantially parallel to the longitudinal axis.

17. The apparatus of claim 8, wherein the threaded fastener includes a head and a threaded end disposed opposite the head, the threaded end including the external threads, the head configured to engage a shoulder formed in the hollow interior of the first barrel when the external threads in the threaded end threadably engage the internal threads of the second barrel.

* * * * *